US005636791A

United States Patent [19]

Leer

[11] Patent Number: 5,636,791

[45] Date of Patent: Jun. 10, 1997

[54] BACKPACK SPRAYER

[75] Inventor: Rick L. Leer, Somerset, Pa.

[73] Assignee: Gilmour, Inc., Newark, Del.

[21] Appl. No.: 499,765

[22] Filed: Jul. 7, 1995

[51] Int. Cl.[6] ..... B05B 9/08

[52] U.S. Cl. ..... 239/142; 239/153; 239/154; 239/373; 366/126

[58] Field of Search ..... 239/152–154, 239/373, 126, 127, 142; 222/175, 383.1, 383.5, 385; 366/136

[56] References Cited

U.S. PATENT DOCUMENTS

| | | | |
|---|---|---|---|
| D. 304,833 | 11/1989 | Luchsinger . | |
| 383,261 | 5/1888 | Weaber . | |
| 1,976,340 | 10/1934 | Gretschel . | |
| 2,083,039 | 6/1937 | Searls . | |
| 2,110,027 | 3/1938 | Santarelli . | |
| 2,162,057 | 6/1939 | Brandt . | |
| 2,192,256 | 3/1940 | Brandt . | |
| 2,281,142 | 4/1942 | Davis | 222/175 |
| 3,428,255 | 2/1969 | Ballu . | |
| 3,844,449 | 10/1974 | Alter | 222/175 |
| 3,966,092 | 6/1976 | Ballu | 222/175 |
| 4,651,903 | 3/1987 | Pagliai | 239/153 X |
| 4,690,331 | 9/1987 | Luchsinger | 239/333 |
| 4,702,416 | 10/1987 | Pagliai et al. | 239/11 |
| 4,702,419 | 10/1987 | Luchsinger | 239/333 |
| 4,768,714 | 9/1988 | Luchsinger | 239/142 |
| 4,798,333 | 1/1989 | Luchsinger | 239/142 |
| 5,150,837 | 9/1992 | Ferrari | 239/153 |
| 5,335,853 | 8/1994 | Wirz | 239/142 |

FOREIGN PATENT DOCUMENTS

| | | | |
|---|---|---|---|
| 268921 | 6/1988 | European Pat. Off. | 239/373 |

*Primary Examiner*—Lesley D. Morris

*Attorney, Agent, or Firm*—Middleton & Reutlinger; John F. Salazar

[57] ABSTRACT

The present invention is for a backpack sprayer which has a reservoir tank fixedly attached to a support frame, the tank having a fill opening located at the top end and a pressure vessel located therein. The pressure vessel has a pump housing located therein which has a one way check valve leading into the pressure vessel, the pump housing also having a cylinder actuated by a hand crank for compressing the sprayed liquid into the pressure vessel. The pressure vessel expels the compressed liquid through a hand held wand operated by the user.

16 Claims, 8 Drawing Sheets

BACKPACK SPRAYER

BACKGROUND OF THE INVENTION

1. Field of the Invention

The present invention relates to a hand operated backpack sprayer pump and wand sprayer assembly. Fluid is contained in a tank which is forced into a pressurized vessel, the fluid contained in said vessel is thereby sustained at high pressure which may be released through a sprayer wand having a spring loaded release valve.

2. Discussion of the prior Art

Many patents have been issued covering manually operated backpack sprayers which have a reservoir tank and pressure vessel located therein. U.S. Pat. No. 5,335,853 teaches a compact and long lasting sprayer pump and agitator combination wherein a pump assembly having a dual acting piston reciprocates within a pump cup housing thereby performing the actions of injecting fluids into a pressure vessel as well as forcing fluid through another conduit to agitate the fluid contained in the tank reservoir. U.S. Pat. No. 4,798,333 teaches a portable sprayer having improved combination of a piston and diaphragm pump wherein the piston forces fluid through a cylinder housing into the pressure vessel in combination with a diaphragm assembly which draws fluid in from the tank and injects it back into the tank at high velocity utilizing the same reciprocating action of the piston. U.S. Pat. No. 4,768,714 teaches a portable sprayer with leak control and agitator and similarly has a single action piston which forces fluid into a pressure vessel by additionally having a diaphragm to inject fluid into the tank at high velocity to agitate said fluid. U.S. Pat. No. 4,702,419 teaches a diaphragm pump wherein fluid is forced into the pressure vessel utilizing only the action of a diaphragm securely held at the bottom of a pump cup. The pump assemblies of the prior art generally utilize diaphragms made of a flexible and resilient material which provides an adequate seal between the piston and the lower pump assembly. However, the diaphragms, after continued use, develop cracks, leaks and various other points which are suspectable to fluid leakage. Additionally, most pump assemblies taught in the prior art utilize steel or other metals which add to the weight of the pump assembly, an undesirable characteristic as the entire sprayer is to be carried on the back of an individual. Pump assemblies of the prior art which do not utilize a diaphragm have typically also posed an additional problem of leakage along the cylinder rod after extended use and do not provide an adequate means of preventing said leakage. In addition, pressure in the pressure vessel may be increased by each action of the manually operated lever until such time as the pressure seals within the pressure vessel give way or until a pressure release valve is activated. However, there is no means to adjust the maximum pressure which is contained within the pressure vessel thereby controlling the internal pressure of the pressure vessel as well as the spray pressure and velocity of fluid ejected from the sprayer wand.

SUMMARY 0F THE INVENTION

The present invention is for a backpack sprayer which has a reservoir tank for holding fluids which are to be sprayed under high pressure. The backpack of the present invention is comprised of light weight polypropylene and polyethylene which adds to the ease or portability of the entire assembly while additionally increasing the life expectancy of the parts. The backpack sprayer of the present invention additionally has means for adjusting the maximum pressure of the pressure vessel which contains the liquid to be sprayed under high pressure. The backpack sprayer of the present invention also has means for adjusting the seal located around the piston thereby allowing the user to prevent leakage from the piston throughout the life of the sprayer.

More particularly, the backpack of the present invention is comprised of a reservoir which is placed on a support frame for carrying said reservoir having located therein a pressure vessel and pump assembly for allowing the liquid to be injected into the pressure vessel and subsequently sprayed at a high velocity due to the increased pressure found therein. The pump of the backpack sprayer has a single action piston which draws fluid into a cylinder or pump housing wherein a pump cup attached to a piston rod and actuated by a manually operated lever draws fluid into the cylinder and forces the fluid under high pressure through a one-way valve into the pressure vessel. The operator increases the pressure of the fluid in the pressure vessel by repeatedly operating the crank which is attached to said piston. The liquid held under high pressure in the pressure vessel can then be ejected at a high velocity from the pressure vessel utilizing a wand sprayer. The wand sprayer is attached to the pressure vessel via a conduit which properly seals off the pressure vessel until a spring loaded valve is activated by the operator. The pressure vessel additionally has located therein a pressure release valve which is manually adjustable from the outside of the reservoir tank thereby allowing the maximum pressure of the pressure vessel to be easily controlled by the operator.

Finally, the present invention comprises a backpack sprayer having a reservoir tank fixedly attached to a support frame, said tank having a top and a bottom portion, a fill opening located at said top portion of said reservoir tank, a pressure vessel located within said reservoir tank and affixed to said bottom of said reservoir tank, a pump housing located within said pressure vessel forming a cylinder therein and having a one way check valve, said pump housing in flow communication with said reservoir tank, a reciprocating pump rod attached at a first distal end to a reciprocally rotated center crank and connected at the opposite distal end to a pump cup located within said cylinder, wherein said pump cup has an open interior portion and angled sides forming a frustum, a pump cup retainer having a circular flange, said pump cup retainer interposed between said pump rod and said pump cup, said pump cup retainer held in place by said annular flange of said pump cup retainer, means to adjustably seal said pump rod at the point of entry into said cylinder, means to reciprocally rotate said center crank, a pressure release valve attached to said pressure vessel and having a pressure release conduit from said pressure vessel into said reservoir, means to adjust said pressure release valve external of said reservoir and said pressure vessel and, a spraying wand in flow communication with said pressure vessel and having a manually operable spring valve.

BRIEF DESCRIPTION OF THE DRAWINGS

A better understanding of the invention will be had upon reference to the following description in conjunction with the accompanying drawings and which like numerals refer to like parts and wherein.

DETAILED DESCRIPTION OF THE PREFERRED EMBODIMENT

Figure 1:
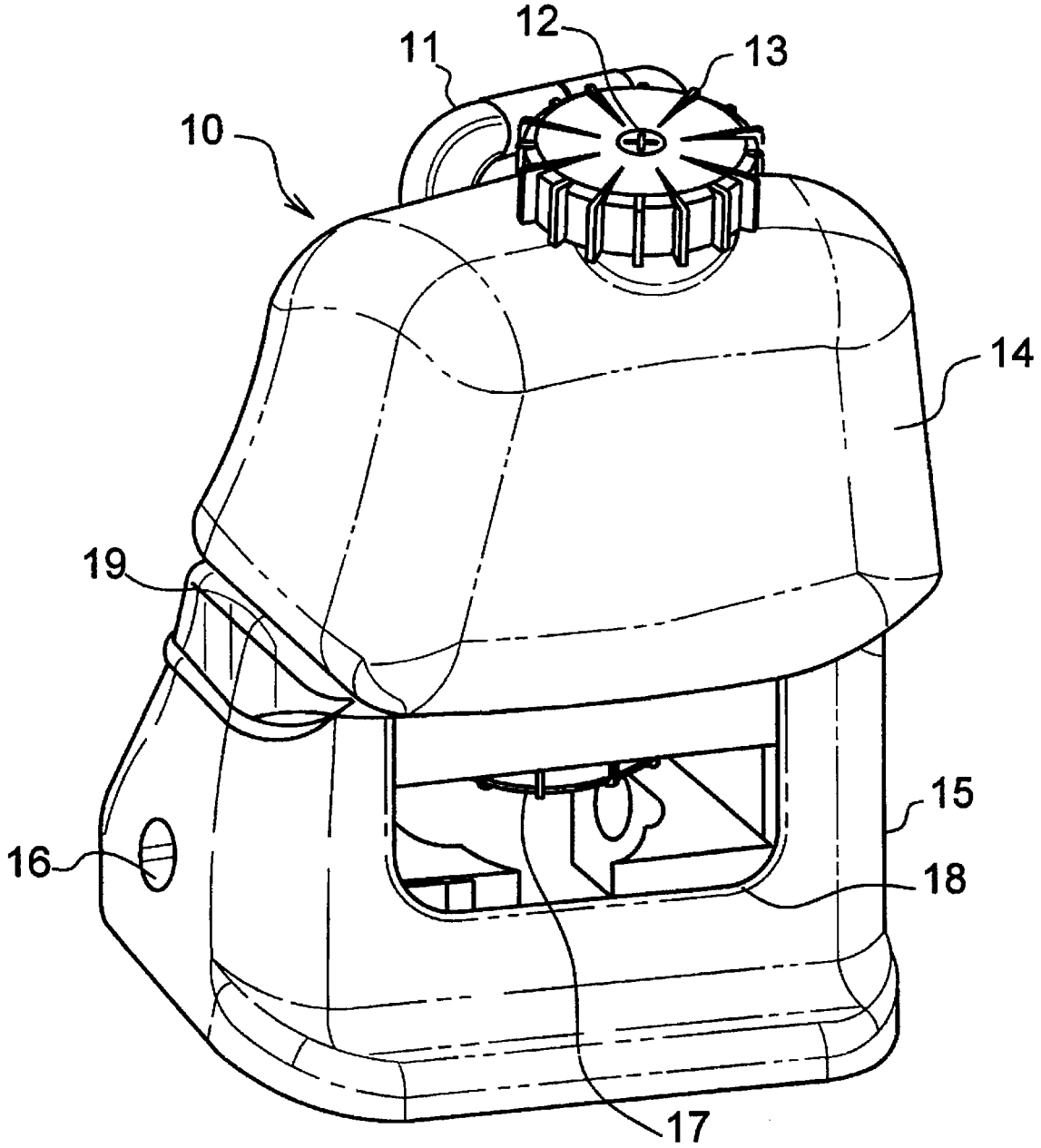
FIG. 1 is a perspective view of the backpack sprayer.

Referring now to the figures, FIG. 1 shows the backpack sprayer 10 of the present invention, which has a handle 11 attached to the reservoir tank 14 of the backpack sprayer. Attached to the back support frame 65 is the reservoir tank 14 which is made of a strong resilient polyethylene material, said reservoir tank 14 containing the mixed liquid which is to be sprayed from the backpack sprayer through the wand. Reservoir tank 14 has on its upper surface lid 13 which is a typical screw lid for sealing the tank. Screw lid 13 additionally has check valve 12 which allows for venting of the reservoir tank 14. Screw lid 13 allows air into the tank through check valve 12 so the interior reservoir tank environment is kept at atmospheric pressure. Check valve 12 does not allow fluid contained in the reservoir tank 13 to flow outside of the tank. The exterior shell of the reservoir tank 14 is made of a resilient plastic material and is attached to base 15 via recessed base clip 19 which merely allows the reservoir tank to be firmly secured onto said base 15.

Figure 5:
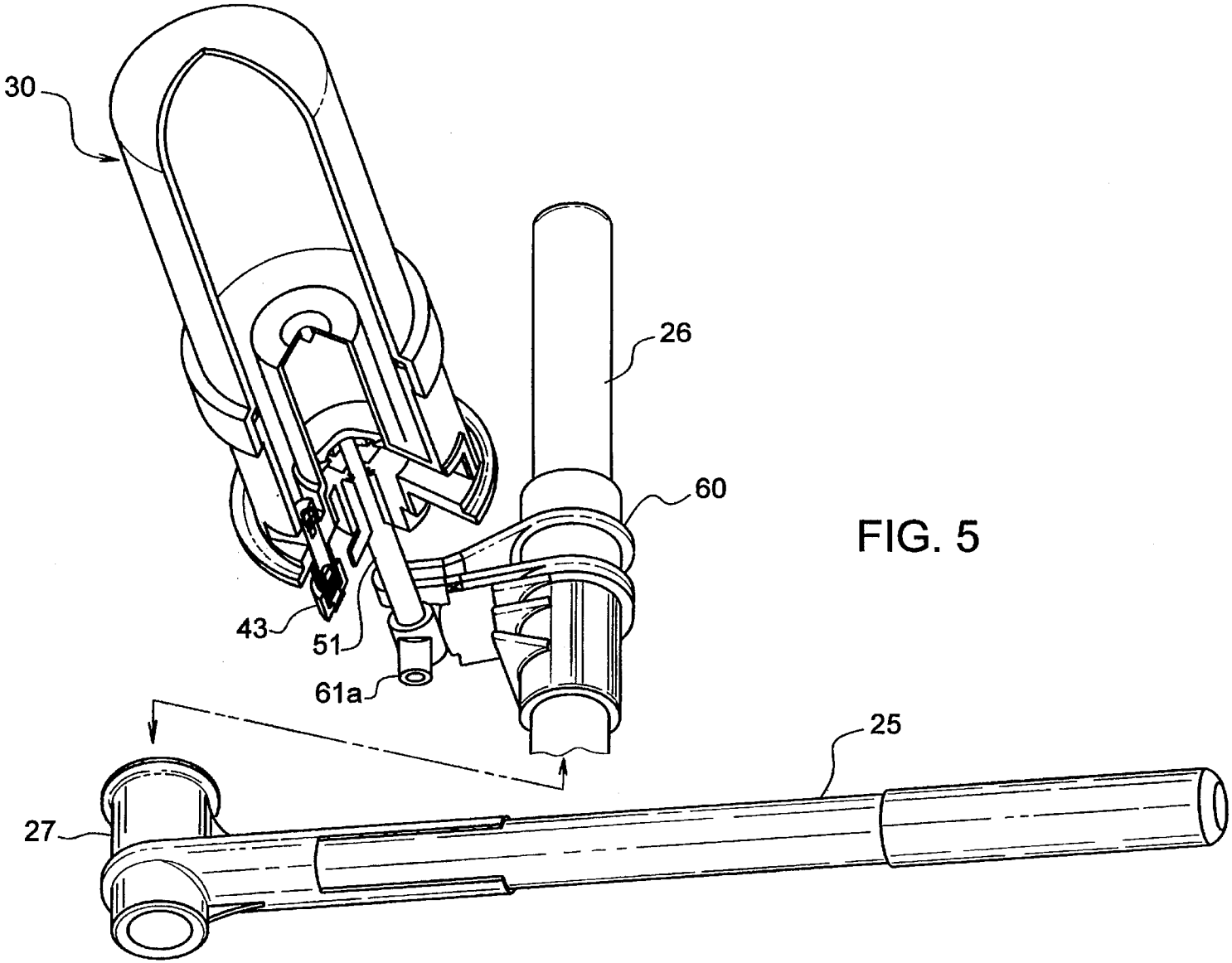
FIG. 5 is a perspective sectional view of the pressure vessel pump assembly and crank arm of the present invention.
Figure 6:
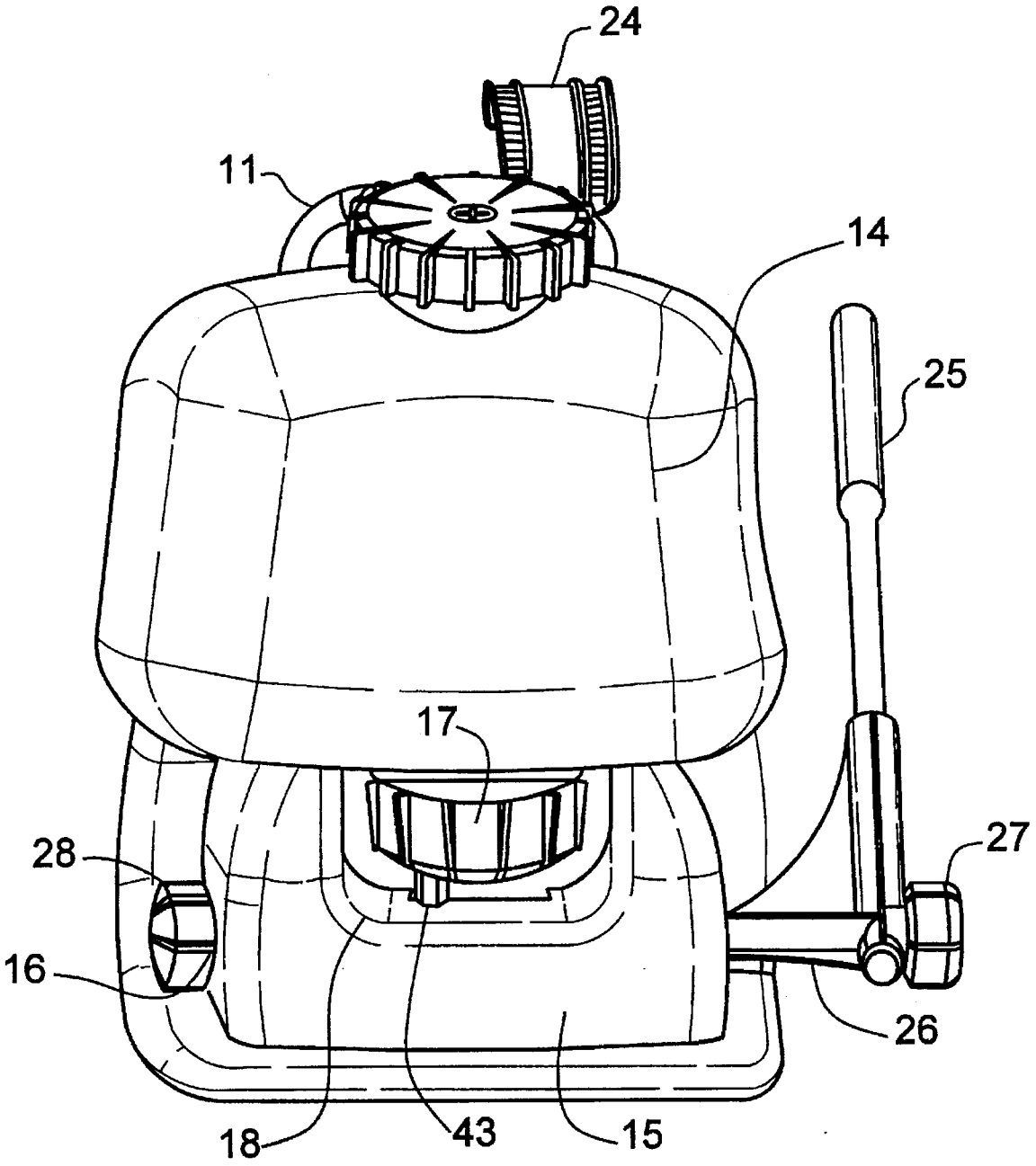
FIG. 6 is a frontal view of the backpack of the present invention showing the shoulder harness and pump crank.

Base 15 has located on both side surfaces entry or access holes, one of which is shown as 16 on FIG. 1, but which appear on both sides of the base 15. Base 15 has access holes for the detachable elbow piece 27, as shown in FIG. 6, to attach crank arm 25 to center crank 26 which drives the pumping apparatus, said elbow piece allowing crank arm 25 to be attached at either side of the sprayer apparatus 10 via detachable elbow piece 27 so that the pump may be manually operated from either the left or right side. Optionally, only one access hole may be provided so that the elbow piece 27 may still be detachable for ease of storing and moving of the backpack sprayer, but may only be attached to a single side of the sprayer, as is shown in FIG. 5.

Base 15 additionally has service panel 18 which is removable and which reveals pump cup 17 which secures the pressure vessel and pump cup 17 to the bottom of the reservoir tank 14. Service panel 18 is strategically located such that removal of the service panel allows for easy accessibility to all the pumping apparatus so that said apparatus may be serviced. Alternatively, the access panel may be placed on the bottom side of base 15 so that an operator, upon removal of the service panel, the entire pumping apparatus is fully exposed increasing the accessibility and serviceability of the entire apparatus.

Located behind the service panel shown in FIG. 6 is the operator adjustment valve 43 which allows the operator to adjust the pressure release valve 42 of the pressure vessel to a specific pressure. This allows the operator to control the maximum pressure within the pressure vessel as well as control the spray velocity of the fluid ejected from wand tip 78.

Figure 2:
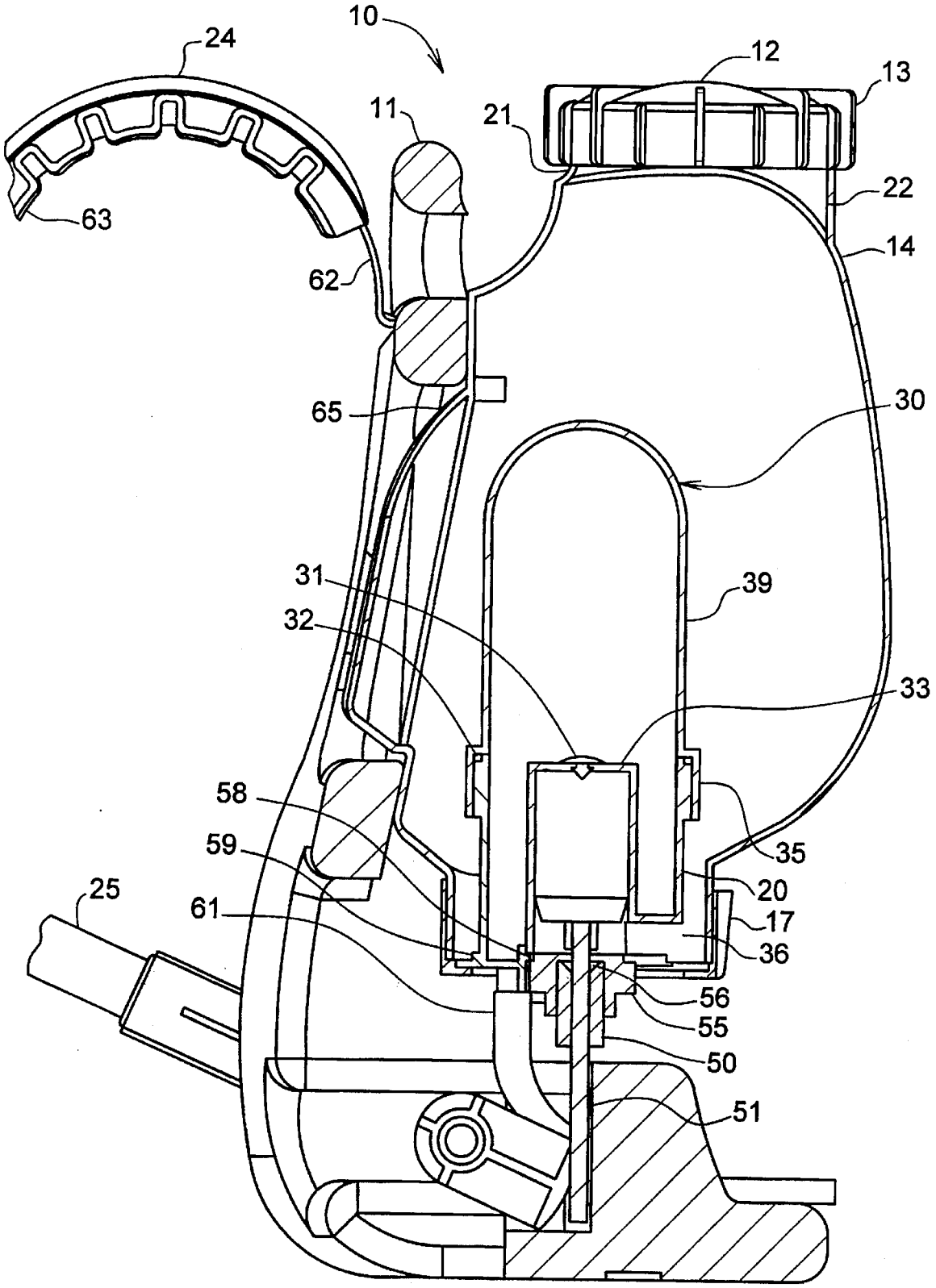
FIG. 2 is a side cut-away view of the backpack sprayer of the present invention.

As shown in FIGS. 2 and 6, the sprayer apparatus 10 has shoulder support 24 which is attached to the handle 11 along should portion 62. The shoulder support also has cushion members 63 to ease the weight carried by the operator. The shoulder support strap 24 is bendable to firmly meet with the surface of the operator's shoulder.

Figures 7, 8:
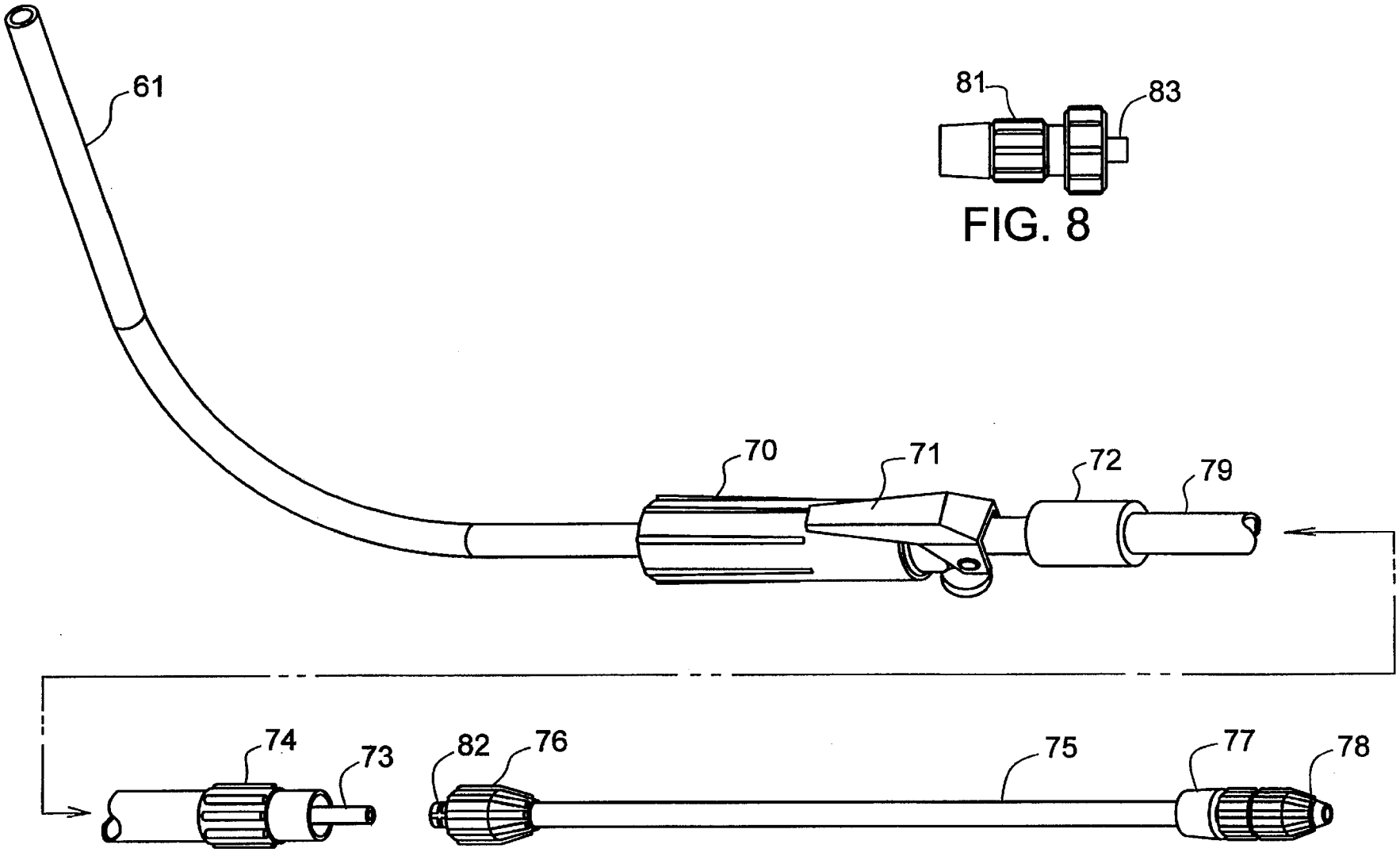
FIG. 7 is a sectional view of the multi-piece sprayer wand.
FIG. 8 is a frontal view of a fan spray nozzle attachment.

Turning now to FIG. 2, the backpack sprayer 10 is shown from the side cut-away view wherein bottle cap 13 and vent check valve 12 are shown attached to the upper portion of reservoir tank 14. Neck portion 21 of the reservoir tank 14 wherein the bottle cap 13 is attached has located thereon an O-ring for proper sealing of the bottle cap as well as a strainer 22 which prevents insoluble material from being inserted into the reservoir tank 14. Located within reservoir tank 14 is pressure vessel 30 which is made of a strong resilient polypropylene material and which is attached at its bottom end to hose 61. Hose 61 of the wand assembly shown in FIG. 7 is attached to the discharge conduit 38 of pressure vessel 30 shown in FIG. 3. There is no valve located at the discharge conduit of the pressure vessel thereby causing the entire hose to be pressurized by the pumping action of the pump assembly. The spring loaded valve 71 of the wand prevents any pressurized fluid from escaping the pressurized pressure vessel and hose.

Hose 61 is attached to attachment 37 which is in flow communication with the inner pressurized portion of the pressure vessel 30. Hose portion 61 remains pressurized while the pressure vessel is under such high pressure as has been manually created by the operator within the pressure vessel. Hose 61 is a flexible hose and ends at valve body handle 70 wherein the spring valve trigger 71 is located. Wand connecter 72 is attached to valve body handle 70 and receives the outer wand 79 which may be made of a stiff resilient plastic or metal alloy. Outer wand 79 has at its opposite distal end male wand connector 74 for attachment to inner spraying wand 75. Inner spraying wand 75 and connector 76 allows inner wand 75 to be telescoped into the interior of outer spraying wand 79. Interior to outer wand 79 is conduit 73 which forms the main channel through which the fluid is sprayed and passes at high velocity. Female wand connector 76 is attached to male wand connector 74 via sealing sleeve 82. Inner spraying wand 75 is also made of a strong resilient plastic or light metal alloy. At the opposite distal end of inner spraying wand 75 is wand tip connector 77 and nozzle 78 which discharges the fluid at high velocity. Optionally, as shown in FIG. 8, tip adaptor 81 and fan spray tip 83 may replace nozzle 78 so that the fluid contained within the pressure vessel may be sprayed at a high velocity with a wide discharge angle.

Figure 3:
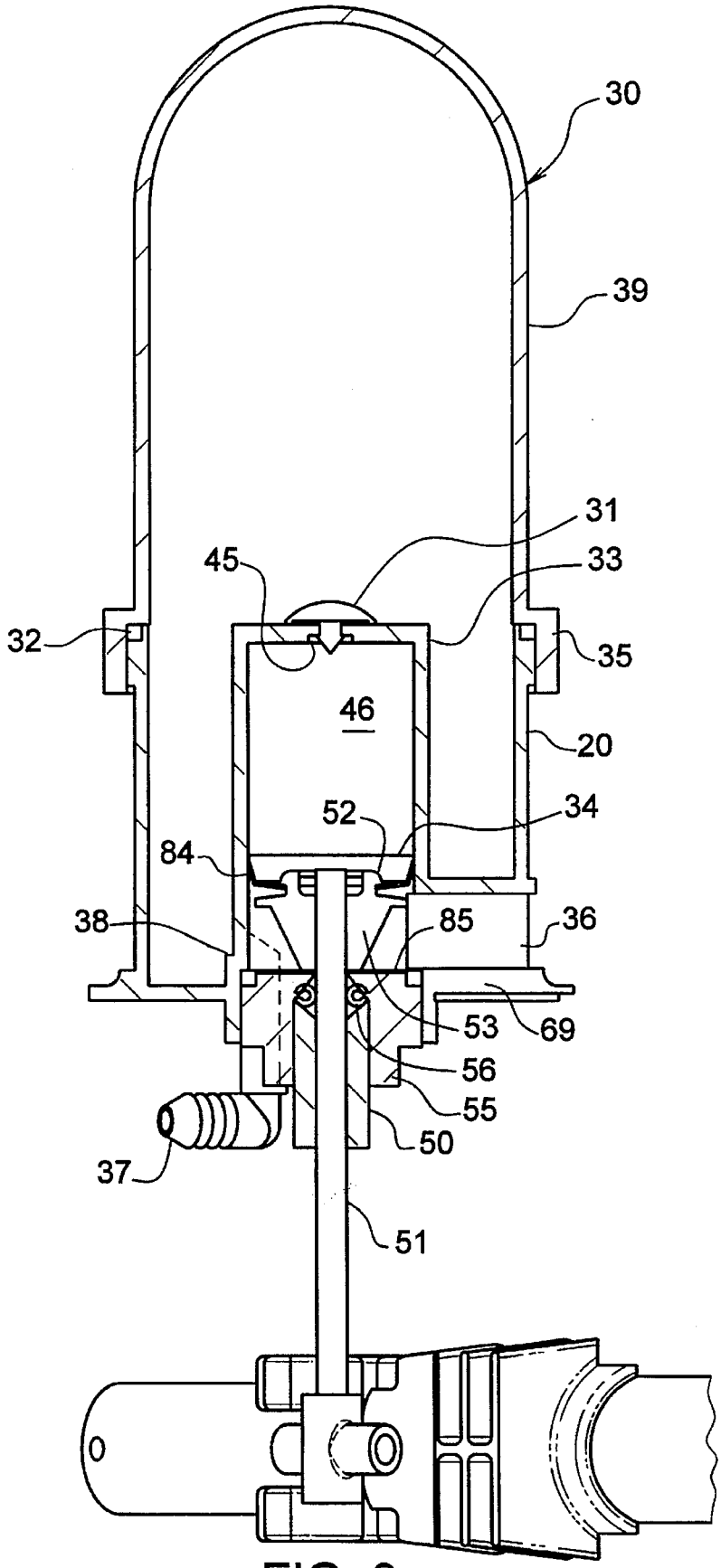
FIG. 3 is a cross sectional view of the pressure vessel and pump assembly.

Returning now to FIG. 2, backpack sprayer 10 has located within reservoir tank 14 pressure vessel 30 which is of cylindrical shape and submerged completely within the contents of reservoir tank 14. Pressure vessel 30 consists of an upper curved cylindrical portion 39 and lower base portion 20. Upper cylindrical portion 39 has outwardly extending flange 35 for receiving base portion 20 between which pump cylinder O-ring 32 is placed for proper sealing of the two sections. As shown in FIG. 3, the lower base portion 20 of the pressure vessel has discharge conduit 38 which is in flow communication with hose 61 attached via a male hose attachment 37.

Figure 4:
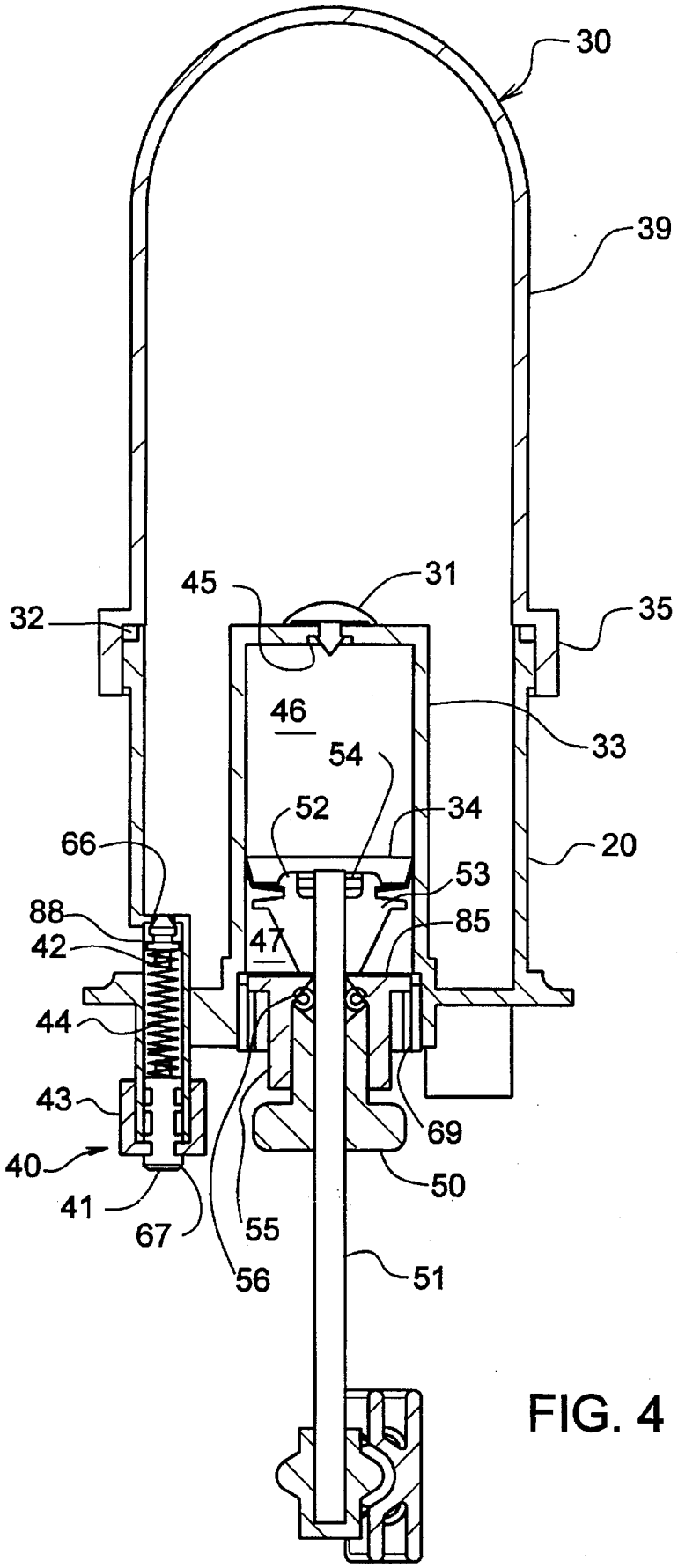
FIG. 4 is a cut-away view of the pressure vessel and pump assembly and showing the pressure release valve.

Lower base 20 of the pressure vessel additionally has pressure release valve assembly 40, as shown in FIG. 4, for release of fluid contained under pressure within the pressure vessel above an operator selected pressure reading. Pressure release valve assembly 40 is comprised of manually adjustable pressure release valve adjusting nut 43 located exterior to the pump assembly and accessible through access panel 18 shown in FIG. 1. Pressure release valve assembly 40 has adjusting nut 43, adjustable stem 41, stainless steel compression spring 44 which is located within a pressure release valve cylinder having valve stems located at each distal end, those being interior pressure release valve stem 42 and lower pressure release valve stem 41, O-ring seal 66 and pressure release conduit 88 which allows fluid released from the pressure vessel to reenter into the reservoir tank 14. Pressure release valve adjustment nut 43 extends outside the pump housing and reservoir tank so that an operator can easily set the maximum spray pressure from between 15 to 90 psi using the adjusting nut to adjust the tension of the pressure release valve spring 44. The pressure release valve assembly 40 additionally sets a maximum pressure which a user can preset using the adjustable nut so that the pressure vessel 30 remains below a predefined critical pressure which could cause damage to the pressure vessel seals and O-rings. Additionally, by allowing the operator to manually control the internal pressure of the pressure vessel, the operator can adjust the spray velocity of the fluid through the wand for differing operable conditions.

Adjustable nut 43 receives lower valve stem 41 which has an outer flange 67 for snapping over the interior opening of nut Lower step 41 is not pressed firmly against nut 43 but merely floats within the nut and presses against spring 44. At the opposite end of pressure spring 44 is located interior pressure release valve stem 42 which has resting upon its upper flange closest to the pressurized chamber O-ring seal 66 for proper sealing of the stem against the pressure vessel housing to insure a proper and tight seal between interior stem 42 and the pressurized chamber. By adjusting the tension of spring 44 via nut 43, which causes stem 41 to press further against the spring, interior stem 42 is pressed more firmly against the orifice between the two chambers thereby requiring increased pressure within the pressure vessel to move stem 42 from within the orifice. Fluid contained within the pressure vessel, once the pressure within the vessel reaches the operator selected value, escapes through the orifice where seal 66 is located and reenters the bottom portion of the reservoir tank 14 via pressure release conduit 88.

Returning again to FIG. 2, the lower base portion of the pressure vessel is attached to the pump assembly and bottom portion of the reservoir tank 14 via pump cap 17, pump O-ring 59, pump nut 55 and wing nut 50 through which the pump rod 51 extends. Pump nut O-ring 58 provides adequate seal between pump nut 55 which is made of a resilient polypropylene and pump base 33. The wing nut 50 has a bevelled end where the threads of said nut are located, said bevelled end forming a recessed area between the end of said wing nut 50 and said pump nut 55 when the two nuts are threadably engaged. The recessed area thereby created may then hold various packing material for sealing. Pump rod 51 extends through TEFLON or polyethylene packing material 56 located interior to pump nut 55 in the recessed formed between the wing nut and the pump nut so that tightening of wing nut 50 increases the pressure of the packing 56 around the pump rod to prevent leakage of fluids located in the pressure vessel 30 and pump base 33 and insuring that none of the fluids contained therein leak onto the operator. Wing nut 50 therefore creates a means to adjustably seal the pump rod 51 as it enters the cylinder formed by the pump housing within the pressure vessel.

Figure 9:
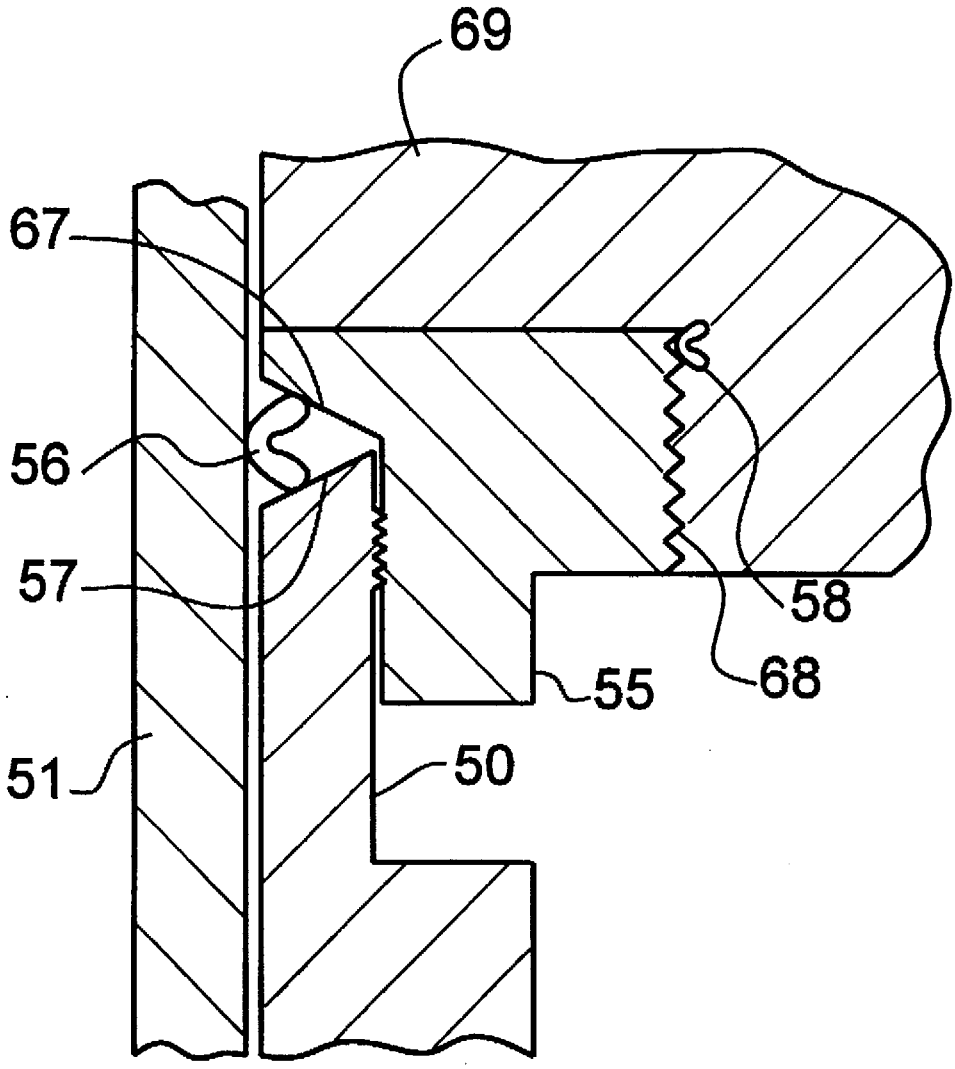
FIG. 9 is a sectional view of the pump housing assembly and pump rod.

As is better shown in FIG. 9, pump rod 51 extends up through wing nut 50 and pump nut 55. Wing nut 50 has an angled upper surface 57 thereby creating a cavity between the wing nut and the pump nut 55, which also has opposing angled surface 67 to create said cavity. Placed within the cavity formed by said angled surfaces 57 and 67 and the wing nut and pump nut is located packing material 56 which may be made of TEFLON or polyethylene material. As the operator turns wing nut 50, packing material 56 collapses upon pump rod 51 thereby creating a tight seal preventing liquid from running down the pump rod from within the pressure vessel.

Pump nut 55 also has threads 68 to mate with the pump housing 33 so that the entire assembly is properly and securely attached to the pump housing. Pump nut 55 has O-ring 58 placed on its upper most thread for sealing the nut with the housing to further secure the housing and pump rod from leakage. O-ring 58 is constructed of a malleable rubber material and molds into the angular crevices of the mating threads between the pump housing and the pump nut.

Pump housing 33 has at its upper flat surface one way check valve 31, which allows fluid compressed within the pump housing chamber to be released into the pressure vessel. As shown in FIG. 3, pump rod 51 is attached at its distal end to pump cup 34 which has the shape of an inverted frustum such that wall 84 presses against the interior of pump housing 33 forming a seal between pump cup 34 in the upper end of the pump housing containing check valve 31. Upon released pressure within pump housing 33 as the pump cup 34 is moving upward and compressing the fluid within the pump housing, the increased pressure forces walls 84 outward against pump housing 33 forming a tight seal between the pump cup 34 and pump housing walls. Check valve 31 snaps into place around a periphery of small holes which are sealed by the upper umbrella shape flange of the check valve. As the pump cup 34 moves upward increasing the pressure of fluid in the pump housing, the check valve is forced upward and fluid flows from the pump housing, through the holes 45 thereby bending the check valve upward and allowing the liquid into the pressure vessel. As the pressure increases in the pressure vessel, the umbrella portion of the check valve is forced downward against holes 45 thereby sealing the pressure vessel from the pump housing and preventing any release of pressurized fluid through check valve 31.

Pump cup 34 is attached to pump rod 51 via pump cup retainer 53 and which has annular flange 52 for compressing against the interior of pump cup 34. Pump cup retainer 53 is threaded onto pumping rod 51 which has mating threads for receiving said retainer. Pump cup retainer 53 is snapped into place around the pump cup 34 via annular flange 52. The pump cup remains free to move in the vertical and horizontal direction by a small amount defined by the diameter distance of flange 52 to the diameter of the receiving hold formed in the base portion of the pump cup retainer. By allowing this vertical and horizontal movement, fluid drawn into the pump housing area 47 through intake channel 36 below the pump cup is forced through the base of the pump cup and into pump housing area 46 above the pump cup during the downstroke of pump rod 51. On the upstroke of the pump rod 51, fluid is drawn into pump housing area 47 through channel 36. The pump cup retainer 53 is forced downward by the increase pressure in pump housing area 46 forcing flange 52 against the base of the pump cup thereby sealing the two pump housing areas and preventing fluid drawn into area 47 from entering area 46. Additionally, the outer rim of pump cup 34 expands slightly against the inner wall of pump housing 33 to create a tight seal. On the downstroke, the fluid in pump housing area 47 forces pump cup 34 upward thereby creating an opening around the base of pump cup 34 and flange 52 of pump cup retainer 53. This action forces the fluid in area 47 into pump housing area 46. Area 54 is the threaded area where the pump cup retainer is threaded onto pump rod 51.

The inflow channel 36 may have a filter screen or some other device to prevent solid material from entering pump housing area 47 and preventing the proper action of the pump cup retainer 53. No valve assembly is required with this design however, thereby allowing fewer parts which may need replacement after extended use.

On the upstroke of piston rod 51 the fluid drawn into pump housing 33 is compressed via pump cup 34 in the pump housing until such pressure is reached causing the one-way check valve 31 to be activated releasing the pressurized fluid from the pump housing 33 into pressure vessel 30. Check valve 31 is made of VITON rubber material which provides enough resilience to prevent the fluid from returning back into the pump housing but also allowing fluid, on the pump rod upstroke, to escape the housing and enter the pressure vessel main chamber.

The high pressure liquid found within the pressure vessel 30 is prevented from exceeding a predefined safety pressure via pressure release valve assembly 40 previously defined. Upon reaching such high pressure, pressure release valve stem 42 activates and allows discharge of high pressure fluid from inside pressure vessel 30 into reservoir tank 14 through pressure release conduit 88. Release of high pressure fluid from within the pressure vessel and into the reservoir tank also acts to agitate and mix the fluid contained within the reservoir tank.

Pump cup 34 is made of polyethylene material which provides for the advantages of being lightweight, flexible, provides excellent characteristic to wear, and strongly seals the pump housing when the piston rod is on the upstroke.

As shown in FIG. 5, reciprocating pump rod 51 is attached to pivot arm 61*a* which itself is attached to rotating center crank 26. Attachment sleeve 60 compresses against center crank shaft 26 thereby producing the reciprocating movement along pivot arm 61. Crank arm 25 attaches to either side of center crank shaft 26 such that center crank shaft 26 may be rotated from either the left or right side of backpack sprayer 10. The up and down movement of crank arm 25 causes direct reciprocation of pump rod 51 thereby activating the pump cup to draw fluid from the reservoir tank into the pump housing through the check valve and into the pressure vessel. Repeated cranking of crank arm 25 increases the pressure of the pressure vessel and allows the operator to eject the fluid through the wand at high velocity.

As shown in FIG. 6, knob 28 may be used to change the side upon which crank arm 25 is operated from and additionally allows center crank shaft 26 to extend from either side of backpack assembly 10. Additionally, as shown in FIG. 6, pressure release valve adjusting nut 43 is shown below pump cap 17 allowing easy accessibility by the operator through access panel 18. Base portion 15 is additionally made of a light weight plastic material and securely attaches to reservoir tank 14 via recessed clamps 19 shown in FIG. 1.

Hose 61 is attached to pump assembly adjacent to pump cap 17 via hose attachment 37, shown in FIG. 3, and may be secured using a screw clamp or other known compression clamp. Hose 61 extends downward through the bottom of pump assembly base 15 to wand handle 70. The hose is continually pressurized while the pressure vessel is pressurized and should therefore be made of a strong but bendable rubber material. The hose should be of sufficient length to allow proper operation of wand handle 70 away from backpack pump 10.

In operation, the backpack sprayer 10 rests upon the shoulder via shoulder harness 24 of the operator with crank arm 25 extending forward from center crank shaft 26. The operator causes an up and down movement of crank arm 25 thereby rotating center crank shaft 26 which has attached at its center most position sleeve bracket 60. Sleeve bracket 60 is attached to piston rod 51 and the back and forth rotation of center crank shaft 26 causes reciprocating motion of pump rod 51 thereby drawing fluid from the reservoir tank through the conduit channel 36 into pump housing area 47. Upon the downstroke of the reciprocating pump rod 51, fluid is forced around cup retainer 53 and into pump housing area 46. When the pressure vessel has attained an increased pressure, wand valve trigger 71 may be activated thereby opening the valve assembly and causing fluid to flow through the hose and wand at a high velocity and eject through nozzle 78. Continued movement of crank arm 25 keeps a constant pressure in the pressure vessel thereby allowing the operator to continually spray fluids from the reservoir tank through the wand nozzle as long as the crank arm is manually operated.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A backpack sprayer, comprising:

a reservoir tank fixedly attached to a support frame, said tank having a top and a bottom portion;

a fill opening located at said top portion of said reservoir tank;

a pressure vessel located within said reservoir tank and affixed to said bottom portion of said reservoir tank;

a pump housing located within said pressure vessel forming a cylinder therein and having a one way check valve, said pump housing in flow communication with said reservior tank;

a reciprocating pump rod attached at a first distal end to a pump cup located within said cylinder, said pump cup having an open interior portion and angled sides, said open interior of said pump cup facing said one way check valve;

a pump cup retainer having a annular flange, said pump cup retainer interposed between said pump rod and said pump cup, said pump cup retained in place by said annular flange of said pump cup retainer;

means to adjustably seal said pump rod at the point of entry into said cylinder;

a pressure release conduit extending from said pressure vessel to said reservoir tank and having a pressure release valve therein;

means to adjust said pressure release valve external of said reservior tank and said pressure vessel; and, a spraying wand in flow communication with said pressure vessel and having a manually operable spring valve.

2. The backpack sprayer of claim 1 wherein said backpack has a shoulder strap attached thereto allowing said backpack to be carried.

3. The packpack sprayer of claim 1 wherein said pressure release valve conduit enters said reservoir tank at said bottom portion of said reservoir tank.

4. The backpack sprayer of claim 3 wherein said pressure release valve is comprised of a pressure release valve cylinder, said pressure release valve cylinder having a lower pressure release valve stem at one end, an interior pressure release valve stem at the opposite end and directly adjacent to said pressure vessel, and a spring located therebetween to force said interior stem and said lower stem away from each other and seal said cylinder, whereby said pressure release valve conduit is located directly below said interior stem allowing fluid to exit said pressure release valve cylinder into said reservoir tank.

5. The backpack sprayer of claim 1 wherein said spraying wand is a dual piece telescoping wand.

6. The backpack sprayer of claim 1 wherein said spraying wand has a removable nozzle.

7. The backpack sprayer of claim 1 wherein said means to adjustably seal said pump rod comprises a wing nut threadably received by a pump nut, said pump nut threadably received by said pump housing, said pump rod extending through said wing nut and said pump nut and into said pump housing.

8. The backpack sprayer of claim 7 wherein said wing nut has a bevelled end and said pump nut has a bevelled interior recess which meets said bevelled end of said wing nut, said bevelled opposing surfaces thereby form a recess therebetween, said recess having located therein packing material which is compressed between said wing nut and said pump nut and against said pump rod.

9. The backpack sprayer of claim 8 wherein said packing material is made of a malleable plastic.

10. The backpack sprayer of claim 1 wherein said reciprocating pump rod is attached at a second distal end to a reciprocally rotatable center crank.

11. The backpack sprayer of claim 10 having means to reciprocally rotate said center crank.

12. The backpack sprayer of claim 4 wherein said means to adjust said pressure release valve comprises a pressure release valve adjusting nut which forces said lower pressure release valve stem towards said interior pressure release valve stem thereby compressing said spring.

13. A backpack sprayer, comprising:

a reservoir tank fixedly attached to a support frame, said tank having a top and bottom portion;

a screw lid removably attached to said top portion of said reservoir tank;

a pressure vessel located within said reservoir tank and affixed to said bottom portion of said reservoir tank;

a pump housing located within said pressure vessel forming a cylinder therein and having a one-way valve entering said pressure vessel, said pump housing having an input conduit from said reservoir tank;

a reciprocating pump rod, said pump rod entering said cylinder through said pump housing;

sealing means surrounding said pump rod and adjacent to said pump housing;

a reciprocally rotating center crank attached to said pump rod at a first distal end;

a pump cup attached to said reciprocating pump rod within said cylinder at a second distal end, said pump cup having an open interior and angled sides forming a frustum;

a pump cup retainer having a annular flange, said pump cup retainer interposed between said pump rod and said pump cup, said pump cup retained in place by said annular flange of said pump cup retainer;

means to compress said sealing means surrounding said pump rod;

a pressure release valve attached to said pressure vessel and having a pressure release conduit from said pressure vessel into said bottom portion of said reservoir tank;

means to adjust said pressure release valve external of said reservior tank and said pressure vessel; and, a dual piece telescoping spraying wand in flow communication with said pressure vessel and having a manually operable spring valve.

14. The backpack sprayer of claim 13 wherein said means to adjust said pressure release valve comprises a pressure release valve adjusting nut which forces a lower pressure release valve stem towards an interior pressure release valve stem thereby compressing a spring located therebetween.

15. The backpack sprayer of claim 13 wherein said means to compress said sealing means comprises a wing nut threadably received by a pump nut, said pump nut threadably received by said pump housing, said pump rod extending through said wing nut and said pump nut and into said pump housing.

16. The backpack sprayer of claim 15 wherein said wing nut has a bevelled end and said pump nut has a bevelled interior recess which meets said bevelled end of said wing nut, said bevelled opposing surfaces of said wing nut and said pump nut thereby form a recess therebetween, said recess having located therein packing material which is compressed between said wing nut and said pump nut and against said pump rod.

* * * * *